US008356378B1

(12) United States Patent
Crooms

(10) Patent No.: US 8,356,378 B1
(45) Date of Patent: Jan. 22, 2013

(54) HAND WORN SCRUBBER

(76) Inventor: Camesha Crooms, Park Forest, IL (US)

( * ) Notice: Subject to any disclaimer, the term of this patent is extended or adjusted under 35 U.S.C. 154(b) by 55 days.

(21) Appl. No.: 12/905,373

(22) Filed: Oct. 15, 2010

(51) Int. Cl.
*A47L 13/19* (2006.01)

(52) U.S. Cl. ..... 15/104.94; 15/227; 2/161.6; 2/163; 401/7

(58) Field of Classification Search ..... 15/104.94, 15/227; 2/16, 20, 161.1, 161.6, 163; 401/7
See application file for complete search history.

(56) References Cited

U.S. PATENT DOCUMENTS 1,438,485 A * 12/1922 Goldberg ..... 15/104.001
2,405,154 A * 8/1946 Logan ..... 401/7
3,711,889 A 1/1973 Jennings
4,593,427 A * 6/1986 Ortolivo ..... 15/227
D347,709 S 6/1994 Pearson
5,441,355 A 8/1995 Moore
5,956,770 A 9/1999 Dennis
6,016,571 A * 1/2000 Guzman et al. ..... 2/167
6,018,837 A 2/2000 Andreu
6,292,948 B1 9/2001 Chen
7,346,955 B2 3/2008 De Laforcade
7,823,245 B2 * 11/2010 Firouzman ..... 15/227
2004/0244132 A1 * 12/2004 Ouellette et al. ..... 15/227
2005/0268422 A1 12/2005 Harrison
2006/0272116 A1 * 12/2006 Thompson ..... 15/227
2007/0086828 A1 4/2007 Stewart
2007/0192975 A1 8/2007 Aseff
2009/0241237 A1 * 10/2009 Greenfield ..... 2/160

* cited by examiner

*Primary Examiner* — Mark Spisich

(57) ABSTRACT

A hand worn scrubber is provided for facilitating cleaning. The scrubber provides for a cleaning agent and multiple scrubbing surfaces on a hand covering. The scrubber includes a glove having an open end designed for receiving a hand. The glove includes palm section, a thumb section, a plurality of finger sections, and a plurality of fingertip sections. A scrubbing member is coupled to the glove. The scrubbing member extends from the plurality of fingertip sections towards the open end. A cleaning agent is positioned in the scrubbing member. The cleaning agent is dispensable from the scrubbing member during use of the scrubbing member. The fingertip sections of the glove have a plurality of fingertip scrubbing nodules to facilitate cleaning of an item by vigorous scrubbing with the fingertip sections.

15 Claims, 3 Drawing Sheets

HAND WORN SCRUBBER

BACKGROUND OF THE DISCLOSURE

1. Field of the Disclosure

The disclosure relates to scrubbing devices and more particularly pertains to a new scrubbing device for facilitating cleaning by providing a cleaning agent and multiple scrubbing surfaces on a hand covering body.

2. Summary of the Disclosure

An embodiment of the disclosure meets the needs presented above by generally comprising a glove having an open end designed for receiving a hand. The glove includes palm section, a thumb section, a plurality of finger sections, and a plurality of fingertip sections. A scrubbing member is coupled to the glove. The scrubbing member extends from the plurality of fingertip sections towards the open end. A cleaning agent is positioned in the scrubbing member. The cleaning agent is dispensable from the scrubbing member during use of the scrubbing member. The fingertip sections of the glove have a plurality of fingertip scrubbing nodules to facilitate cleaning of an item by vigorous scrubbing with the fingertip sections.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
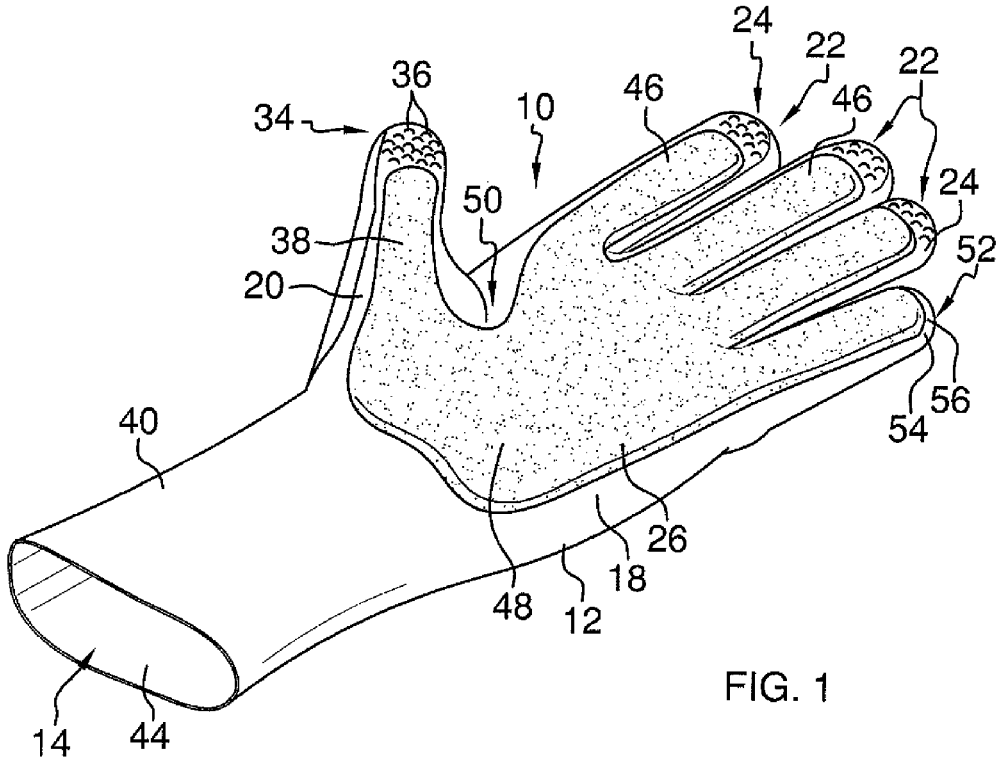
FIG. 1 is a bottom front side perspective view of a hand worn scrubber according to an embodiment of the disclosure.
Figure 2:
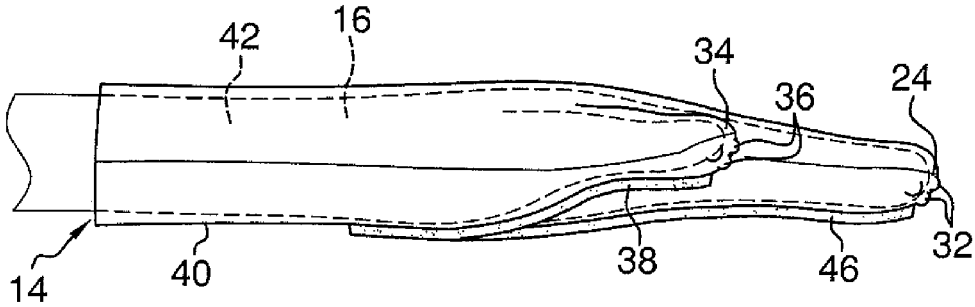
FIG. 2 is a side view of an embodiment of the disclosure.
Figure 3:
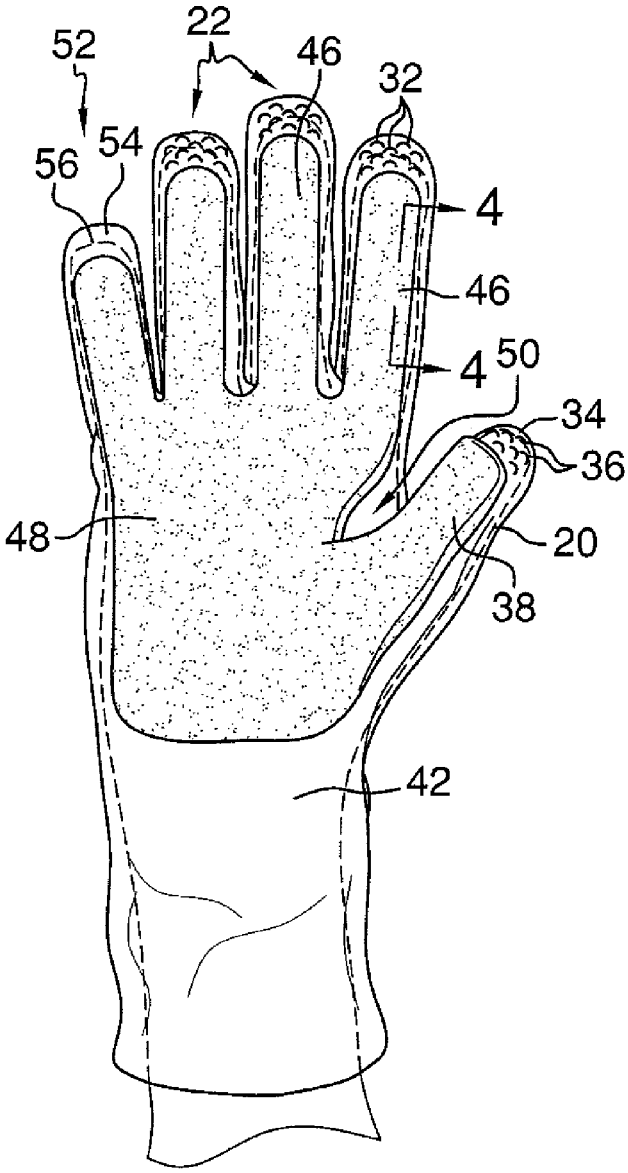
FIG. 3 is a front view of an embodiment of the disclosure.

With reference now to the drawings, and in particular to FIGS. 1 through 6 thereof, a new scrubbing device embodying the principles and concepts of an embodiment of the disclosure and generally designated by the reference numeral 10 will be described.

As best illustrated in FIGS. 1 through 6, the hand worn scrubber 10 generally comprises a glove 12 having an open end 14 designed for receiving a hand 16. The glove 12 includes palm section 18, a thumb section 20, a plurality of finger sections 22, and a plurality of fingertip sections 24. A scrubbing member 26 is coupled to the glove 12. The scrubbing member 26 extends from the plurality of fingertip sections 24 towards the open end 14. A cleaning agent 30 is positioned in the scrubbing member 26. The cleaning agent 30 is dispensable from the scrubbing member 26 during use of the scrubbing member 26. The fingertip sections 24 of the glove 12 have a plurality of fingertip scrubbing nodules 32 to facilitate cleaning of an item by vigorous scrubbing with the fingertip sections 24.

The glove 12 also has a thumb tip section 34. The thumb tip section 34 has a plurality of thumb tip scrubbing nodules 36. The scrubbing member 26 has a thumb portion 38 extending from the thumb tip section 34 towards the open end 14. The glove 12 also has a wrist section 40 extending from the palm section 18 such that the glove 12 is designed for covering a wrist 42 of a user. The wrist section 40 is of sufficient length to inhibit fluids from passing through the open end 14 into an interior 44 of the glove 12 in the event the glove 12 is inserted into a full sink or bucket.

The scrubbing member 26 has a finger portion 46 and a palm portion 48. The palm portion 48 is positioned between the thumb portion 38 and the finger portion 46. A notch 50 extends into the palm portion 48 of the scrubbing member 26. The notch 50 is positioned between the thumb portion 38 and the finger portion 46 to facilitate free movement of the thumb section 20 during use.

The glove 12 may also include a pinky finger section 52 and a pinky fingertip section 54. The scrubbing member 26 extends from the pinky fingertip section 54 towards the open end 14. As the pinky of a user's hand will typically be weaker than other fingers and less likely to be used for scrubbing, the pinky fingertip section 54 may have a smooth outer surface 56.

Figure 4:
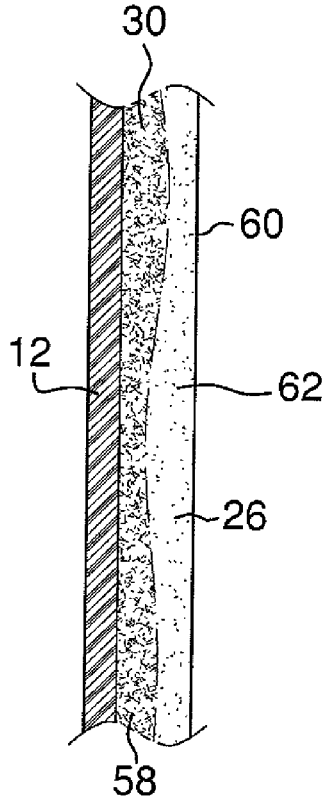
FIG. 4 is a cross-sectional view of an embodiment of the disclosure taken along line 4-4 of FIG. 3.
Figure 5:
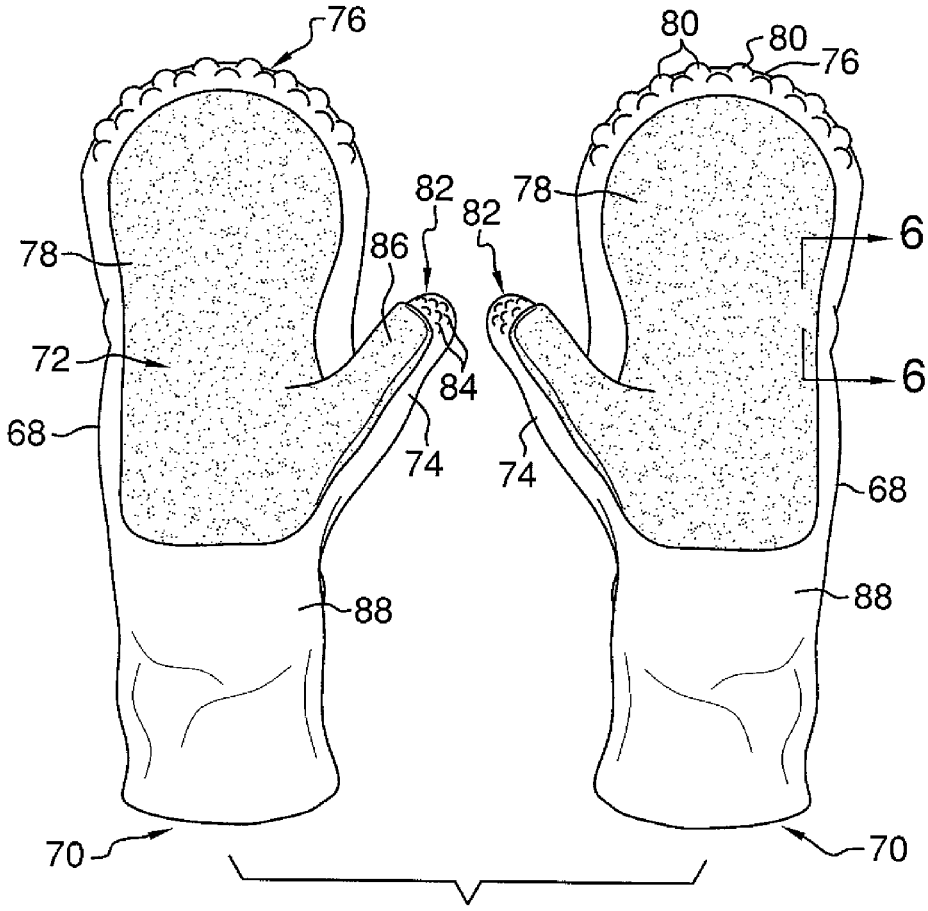
FIG. 5 is a front view of an embodiment of the disclosure.
Figure 6:
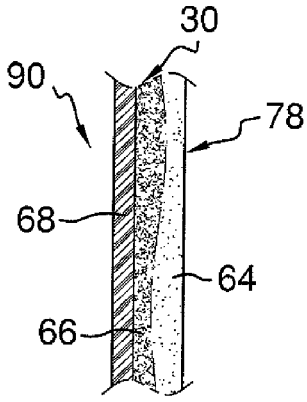
FIG. 6 is a cross-sectional view of an embodiment of the disclosure taken along line 6-6 of FIG. 5.

The cleaning agent 30 may be a water-soluble detergent 58 positioned adjacent the glove 12 in spaced relationship to an outer surface 60 of the scrubbing member 26 prior to use as shown in FIG. 4. The scrubbing member 26 may compliment the particular type of cleaning agent 30 provided such as being a sponge 62 to compliment the detergent 58 or an absorbent cloth 64 to compliment a furniture polish 66 or the like. A variety of cleaners may be incorporated into the invention which may also incorporate various scents and decorative designs.

The scrubber 10 may be provided in a mitten 68 having an open end 70 designed for receiving a hand. The mitten 68 includes a palm segment 72, a thumb segment 74, and a fingertip segment 76. A scrubbing member 78 is coupled to the mitten 68. The scrubbing member 78 extends from the fingertip segment 76 towards the open end 70. The cleaning agent 30 is positioned in the scrubbing member 78 and is dispensable from the scrubbing member 78 during use of the scrubbing member 78. The fingertip segment 76 of the mitten 68 has a plurality of fingertip scrubbing protrusions 80. The mitten 68 has a thumb tip segment 82 having a plurality of thumb tip scrubbing protrusions 84. The scrubbing member 78 has a thumb portion 86 extending from the thumb tip segment 82 towards the open end 70. The mitten 68 also has a wrist segment 88 extending from the palm segment 72 such that the mitten 68 is designed for covering the wrist 42 of the user. Similarly to wrist section 40, wrist segment 88 is of sufficient length to inhibit fluid from passing into an interior 90 of the mitten 68 during use.

In use, the glove 12 or mitten 68 is placed on the hand 16 of the user. The scrubbing member 26 or 78 is typically wetted to release the cleaning agent 30. The scrubbing member 26 or 78 is then used to clean as desired. The nodules 32, thumb tip scrubbing modules 36, protrusions 80, and thumb tip scrubbing protrusions 84 are then used as desired to facilitate cleaning.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A scrubbing assembly comprising:

a glove having an open end adapted for receiving a hand, a palm section, a thumb section, a plurality of finger sections, and a plurality of fingertip sections;

a scrubbing member coupled to said glove, said scrubbing member extending from said plurality of fingertip sections towards said open end;

a cleaning agent positioned in said scrubbing member, said cleaning agent being dispensable from said scrubbing member during use of said scrubbing member; and said fingertip sections of said glove having a plurality of fingertip scrubbing nodules.

2. The assembly of claim 1, further including said glove having a thumb tip section, said thumb tip section having a plurality of thumb tip scrubbing nodules.

3. The assembly of claim 2, further including said scrubbing member having a thumb portion extending from said thumb tip section towards said open end.

4. The assembly of claim 3, further comprising:

said scrubbing member having a finger portion and a palm portion, said palm portion being positioned between said thumb portion and said finger portion; and a notch extending into said palm portion of said scrubbing member, said notch being positioned between said thumb portion and said finger portion to facilitate free movement of said thumb section during use.

5. The assembly of claim 1, further including said glove having a wrist section extending from said palm section such that said glove is adapted for covering a wrist of a user.

6. The assembly of claim 1, further comprising said cleaning agent being a water-soluble detergent positioned adjacent said glove in a spaced relationship to an outer surface of said scrubbing member prior to use.

7. The assembly of claim 6, further including said scrubbing member being a sponge.

8. The assembly of claim 1, further comprising said cleaning agent being a furniture polish.

9. The assembly of claim 8, further including said scrubbing member being a layer of an absorbent cloth.

10. The assembly of claim 1, further comprising:

said glove including a pinky finger section and a pinky fingertip section;

said scrubbing member extending from said pinky fingertip section towards said open end; and said pinky fingertip section having a smooth outer surface.

11. A scrubbing assembly comprising:

a glove having an open end adapted for receiving a hand, a palm section, a thumb section, a plurality of finger sections, and a plurality of fingertip sections;

a scrubbing member coupled to said glove, said scrubbing member extending from said plurality of fingertip sections towards said open end;

a cleaning agent positioned in said scrubbing member, said cleaning agent being dispensable from said scrubbing member during use of said scrubbing member;

said fingertip sections of said glove having a plurality of fingertip scrubbing nodules;

said glove having a thumb tip section, said thumb tip section having a plurality of thumb tip scrubbing nodules;

said scrubbing member having a thumb portion extending from said thumb tip section towards said open end;

said glove having a wrist section extending from said palm section such that said glove is adapted for covering a wrist of a user;

said scrubbing member having a finger portion and a palm portion, said palm portion being positioned between said thumb portion and said finger portion;

a notch extending into said palm portion of said scrubbing member, said notch being positioned between said thumb portion and said finger portion to facilitate free movement of said thumb section during use;

said glove including a pinky finger section and a pinky fingertip section;

said scrubbing member extending from said pinky fingertip section towards said open end; and said pinky fingertip section having a smooth outer surface.

12. The assembly of claim 11, further comprising said cleaning agent being a water-soluble detergent positioned adjacent said glove in a spaced relationship to an outer surface of said scrubbing member prior to use.

13. The assembly of claim 12, further including said scrubbing member being a sponge.

14. The assembly of claim 11, further comprising said cleaning agent being a furniture polish.

15. The assembly of claim 14, further including said scrubbing member being a layer of an absorbent cloth.

* * * * *